US010835088B2

(12) United States Patent
Song

(10) Patent No.: US 10,835,088 B2
(45) Date of Patent: Nov. 17, 2020

(54) APPARATUS FOR ASSISTING TOILET USER IN STANDING UP

(71) Applicant: Soon Young Song, Anyang-si (KR)

(72) Inventor: Soon Young Song, Anyang-si (KR)

( * ) Notice: Subject to any disclaimer, the term of this patent is extended or adjusted under 35 U.S.C. 154(b) by 0 days.

(21) Appl. No.: 16/416,258

(22) Filed: May 19, 2019

(65) Prior Publication Data

US 2020/0305661 A1 Oct. 1, 2020

(30) Foreign Application Priority Data

Apr. 1, 2019 (KR) ..... 10-2019-0037622

(51) Int. Cl.
*A47K 13/10* (2006.01)

(52) U.S. Cl.
CPC ..... *A47K 13/10* (2013.01)

(58) Field of Classification Search
CPC .... A47K 13/10; A47K 13/105; A61G 7/1007; A61G 7/10; A61G 7/1017
USPC ..... 4/667
See application file for complete search history.

(56) References Cited

U.S. PATENT DOCUMENTS 5,155,873 A * 10/1992 Bridges ..... A61G 7/1007 297/330
5,189,739 A * 3/1993 Thierry ..... A47K 13/28 4/237
5,440,767 A * 8/1995 Bergenwall ..... A47K 13/10 4/254
5,790,995 A * 8/1998 Caden ..... A61G 7/1005 4/491
6,189,164 B1 * 2/2001 Krapu ..... A61G 5/14 297/313
6,360,382 B1 * 3/2002 Karash ..... A61G 7/1007 4/667
8,556,347 B2 * 10/2013 Lin ..... A61G 5/14 297/334
9,662,252 B1 * 5/2017 Pearson ..... A47K 17/026
2006/0048294 A1 * 3/2006 Maguire ..... A61G 7/1094 4/496
2008/0038107 A1 * 2/2008 Henshaw ..... A61G 7/1007 414/816
2013/0232686 A1 * 9/2013 Schwartz ..... A61G 7/1007 4/667
2014/0123382 A1 * 5/2014 Mastropole ..... A61G 7/1007 4/667
2014/0338119 A1 * 11/2014 Henshaw ..... A61G 7/1007 4/667
2015/0182402 A1 * 7/2015 Nelson ..... A47K 11/04 4/667
2016/0067125 A1 * 3/2016 Splane, Jr. ..... A61G 5/14 297/250.1
2020/0008992 A1 * 1/2020 Song ..... A61G 5/14

FOREIGN PATENT DOCUMENTS

KR 20-0232669 Y1 10/2001

* cited by examiner

*Primary Examiner* — Benjamin R Shaw
(74) *Attorney, Agent, or Firm* — Revolution IP, PLLC

(57) ABSTRACT

An apparatus for aiding a toilet user in standing up, has a simple structure for aiding a toilet user in standing up, in which a movable seat where the toilet user sits is automatically movable to have lifting movement and pivoting movement, and minute pivoting movement is possible, thereby simplifying the structure and assisting the toilet user in safely standing up.

1 Claim, 6 Drawing Sheets

APPARATUS FOR ASSISTING TOILET USER IN STANDING UP

CROSS-REFERENCE TO RELATED APPLICATION

This application claims priority from Korean Patent Application No. 10-2019-0037622, filed on Apr. 1, 2019 in the Korean Intellectual Property Office, the disclosure of which is incorporated herein by reference.

BACKGROUND OF THE INVENTION

(a) Field of the Invention

The disclosure relates to an apparatus for aiding a toilet user in standing up, and more particularly to an apparatus having a simple structure for aiding a toilet user in standing up, in which a movable seat where the toilet user sits is automatically movable to have lifting movement and pivoting movement, and minute pivoting movement is possible, thereby simplifying the structure and assisting the toilet user in safely standing up.

(b) Description of the Related Art

In general, a toilet includes a main body installed on a floor and having a moderate height so that a user can sit to relieve himself/herself, and a seat provided on the top of the main body and hinged at the back to be lifted up as necessary.

Such a toilet is comfortable to sit down and relieve nature, but makes various sick people, elderly or weak people, and disabled people, whose legs are weak, feel much difficulty in standing up from a seating position after easing nature.

To make up for such shortcomings, an sub sidebar has been conventionally installed around a toilet so that the sick people, elderly or weak people, and disabled people can sit down or stand up grabbing the side bar. However, most of them whose legs are weak are also weak in arms and therefore have a problem of difficulty in leaning on the side bar.

To solve this problem, Korean Utility Model No. 20-0232669 (hereinafter, referred to as the "related art") has proposed a toilet seat for the elderly, the weak and the lower-body disabled so that the disabled, the elderly, the weak and the like lower-body handicapped people can easily stand up from a sitting position without effort after relieving nature.

The toilet seat of the related art has an advantage of assisting the elderly, the weak and the like people in standing up easily, but is useless for the elderly, the weak and the disabled who cannot operate it with their own strength because the toilet seat employs a structure of being operated by the strength of the elderly, the weak and the like people. Besides, the toilet seat of the related art has a disadvantage of resulting in considerably high possibility of unexpected severe accidents while the elderly, the weak and the disabled operate it with their own strength.

Further, to assist the elderly, the weak and the like people in easily and safely standing up, not only lifting movement for vertically moving the seat up and down but also pivoting movement to be used in combination with the lifting movement is required. However, such combination of the lifting movement and the pivoting movement makes a structure complicated and big. Accordingly, there is a need of a standing aid having a simple and small structure.

Further, recently, there has been released a toilet of which a seat is automatically liftable to assist the elderly, the weak and the like people in standing up. However, too much pivoting movement of the seat may cause the elderly, the weak and the like people to fall forward, and in this case, there is considerably high possibility that the elderly, the weak and the like people may have irreversible severer accidents.

SUMMARY OF THE INVENTION

Accordingly, the disclosure is conceived to solve the foregoing problems, and an aspect of the disclosure is to provide an apparatus having a simple structure for aiding a toilet user in standing up, in which a movable seat where the toilet user sits is automatically movable to have lifting movement and pivoting movement, and minute pivoting movement is possible, thereby simplifying the structure and assisting the toilet user in safely standing up.

In accordance with an embodiment of the present disclosure, there is provided an apparatus for aiding a user of a toilet in standing up, which has a structure where the user can sit, and includes a movable seat movably mounted to the toilet; and a seat actuator disposed adjacent to the toilet and actuating the movable seat to operate having at least one of lifting movement and pivoting movement, the seat actuator including: a base frame adjacent to and stationarily mounted to the toilet; a driver mounted to the base frame; and a link assembly connected to an actuation bar coupled to the movable seat and making the actuation bar operate as driven by the driver to generate the lifting movement and the pivoting movement of the movable seat, the link assembly including: a stationary link connected vertically to the base frame; a first pivoting link including a first end pivotally connected to the stationary link and a second end pivotally connected to the actuation bar; and a second pivoting line placed above the first pivoting link and including a first end pivotally connected to the stationary link and a second end pivotally connected to the actuation bar, the driver being pivotally connected to the base frame or the stationary link, and including a driving shaft driven to move forward and backward by the driver as pivotally connected to the first pivoting link or the second pivoting link, and the first pivoting link and the second pivoting link being arranged in parallel with each other, and the second pivoting link being longer than the first pivoting link.

Here, the first pivoting link or the second pivoting link may further include a guide pin, and a guide frame connected perpendicularly to the base frame may be further provided including a guide hole configured to guide the guide pin moving according to the movement of the first pivoting link or the second pivoting link.

BRIEF DESCRIPTION OF THE DRAWINGS

The above and/or other aspects of the disclosure will become apparent and more readily appreciated from the following description of the exemplary embodiments, taken in conjunction with the accompanying drawings, in which:

FIGS. 5 to 7 are lateral views for explaining operation of a seat actuator in an apparatus for aiding a toilet user in standing up according to an embodiment of the disclosure.

DETAILED DESCRIPTION

Below, embodiments of an apparatus for aiding a toilet user in standing up according to the disclosure with the foregoing objects, solutions, and effects will be described in detail with reference to the accompanying drawings.

Figure 1:
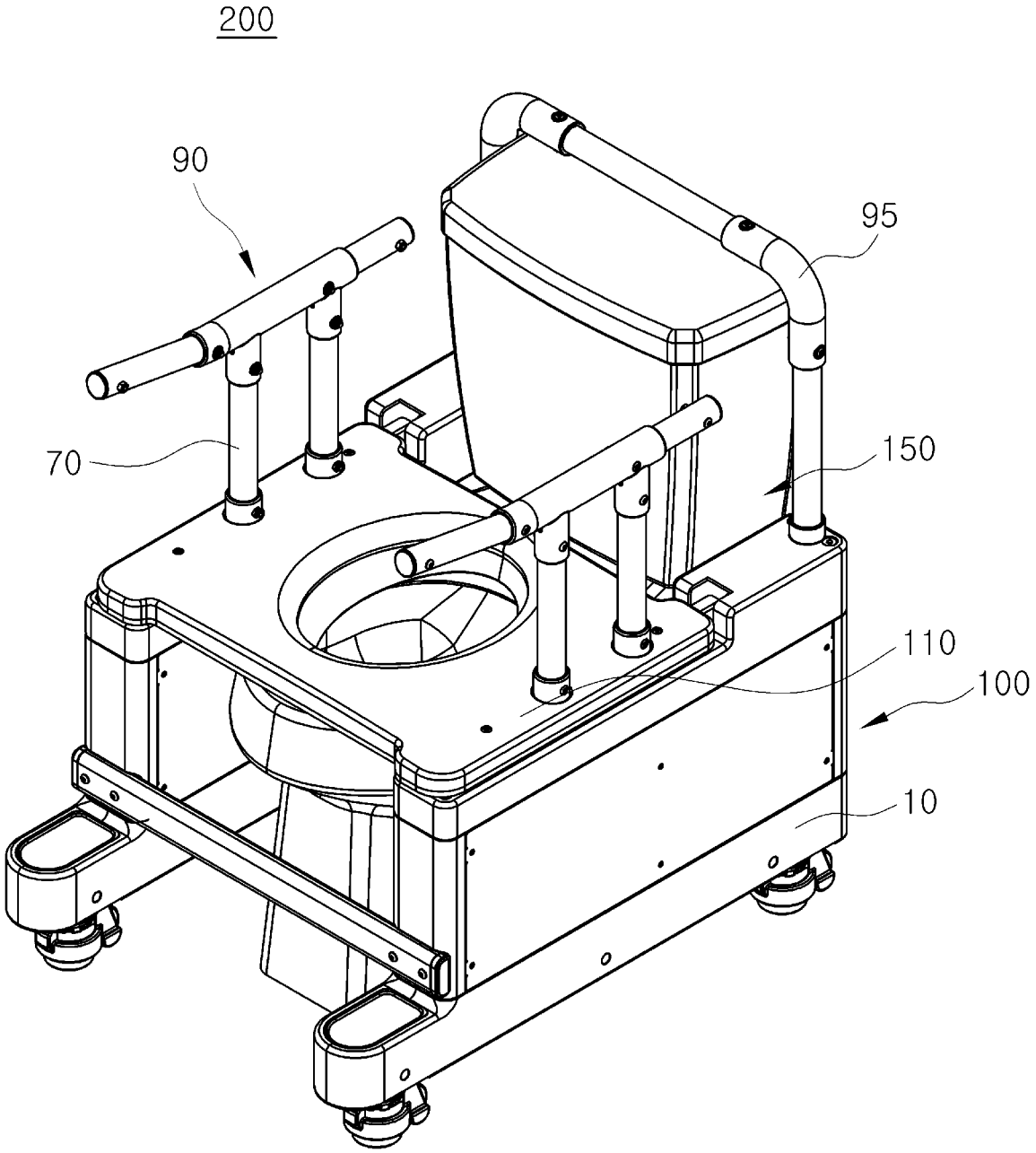
FIGS. 1 and 2 are a perspective view and a lateral view of an apparatus for aiding a toilet user in standing up according to an embodiment of the disclosure.
Figure 2:
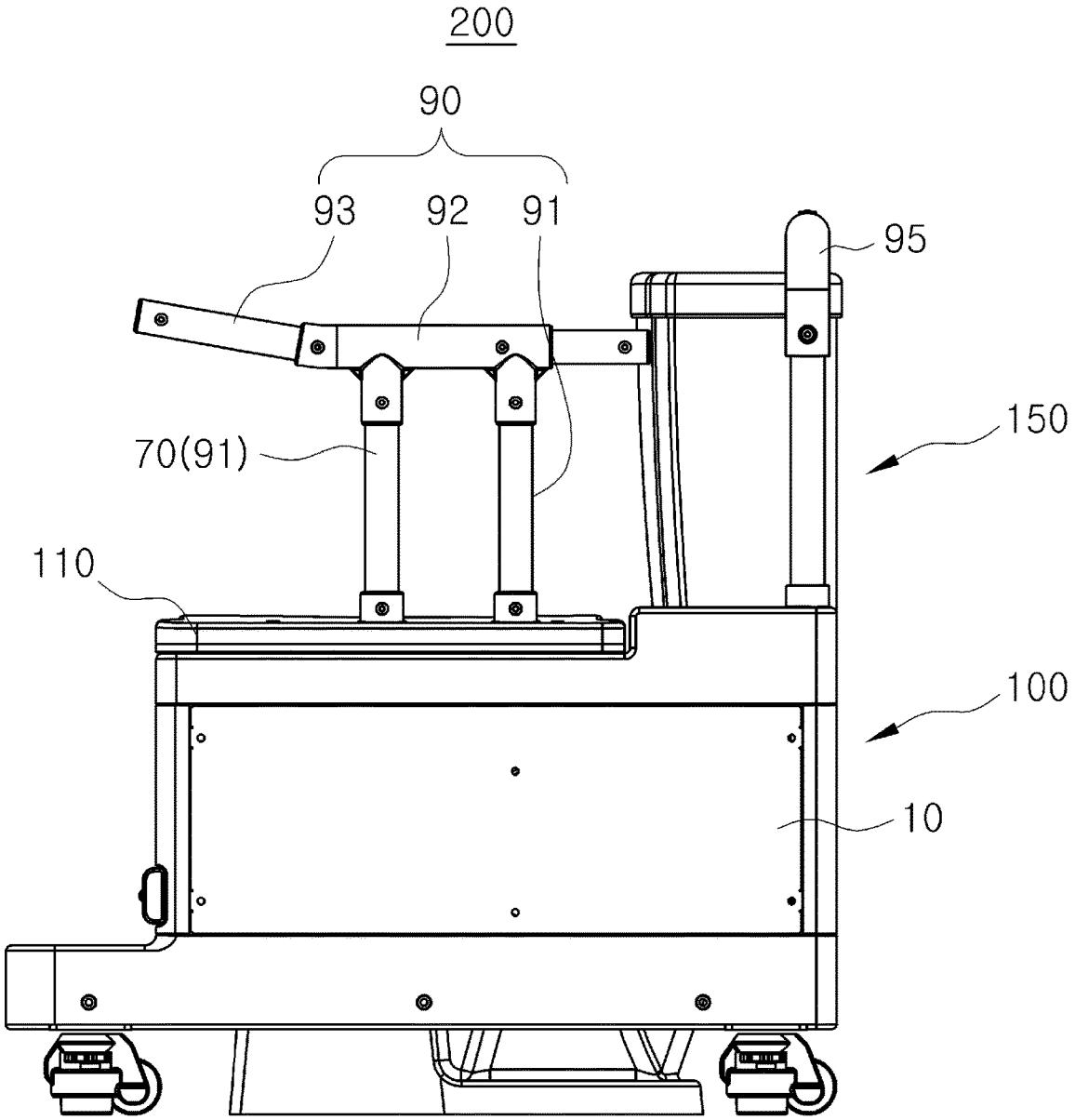
Figure 3:
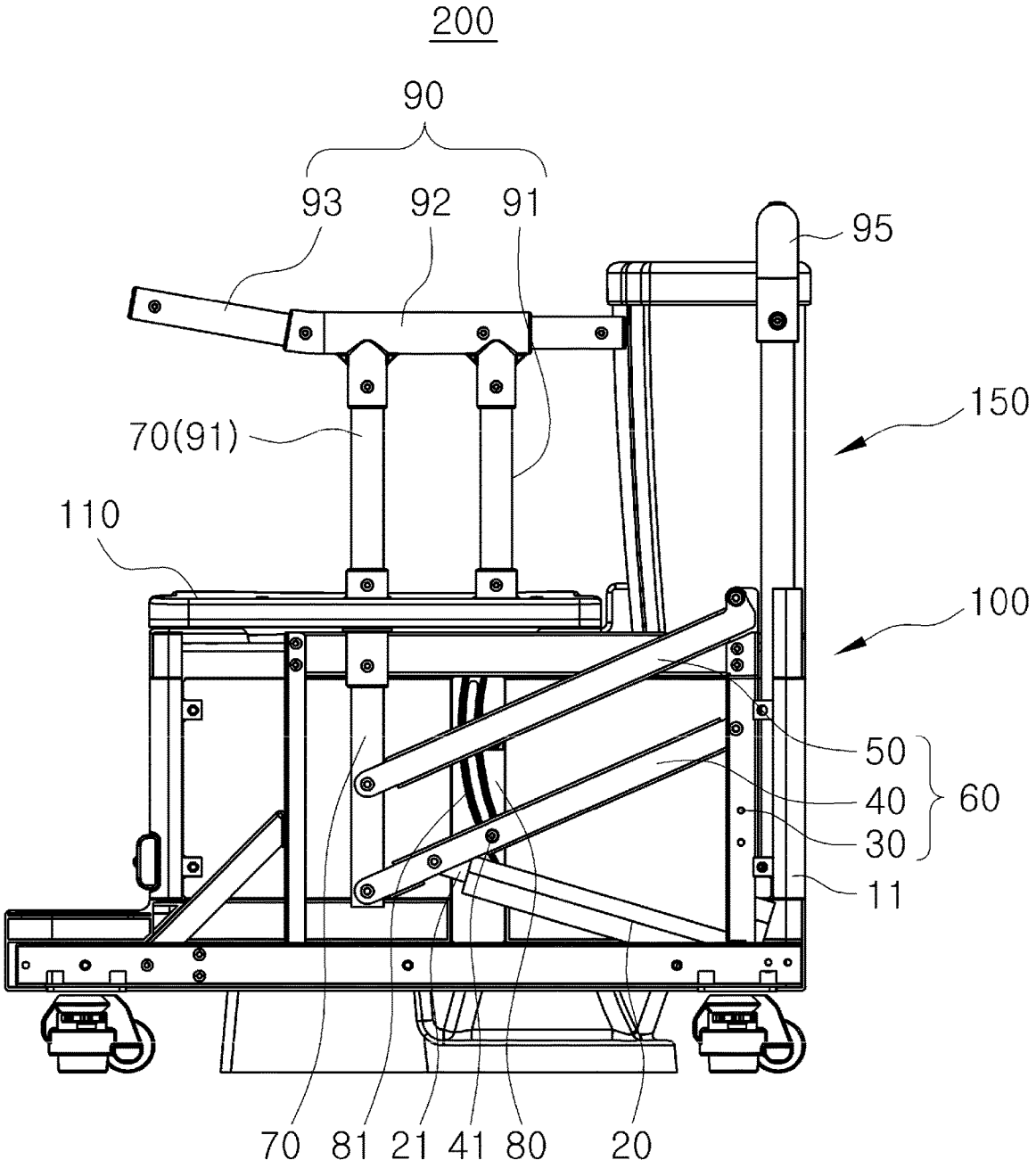
FIGS. 3 and 4 are lateral views of an apparatus for aiding a toilet user in standing up according to an embodiment of the disclosure before operation (in a movable seat down state) and after operation (in a movable seat up state)
Figure 4:
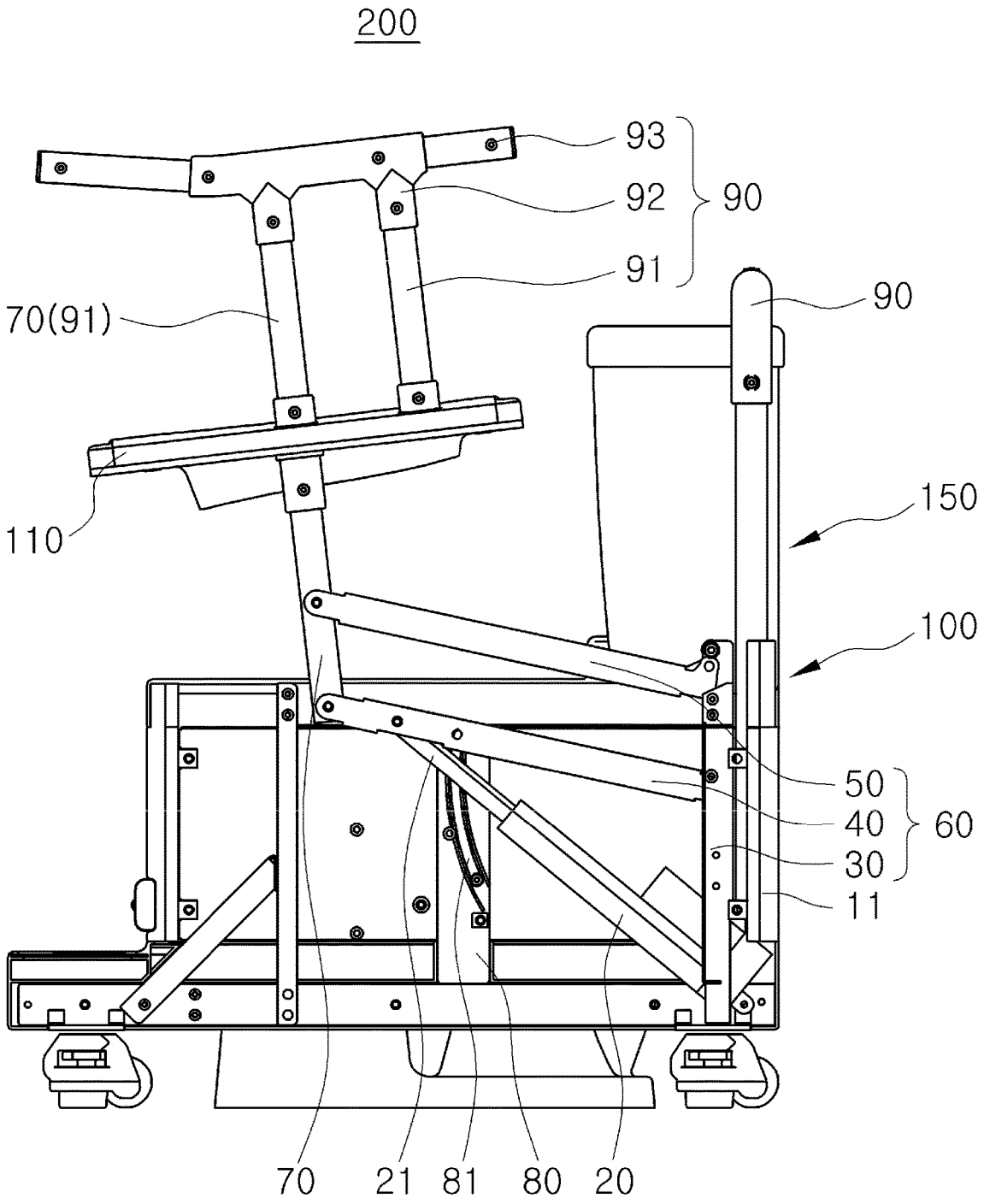
Figure 5:
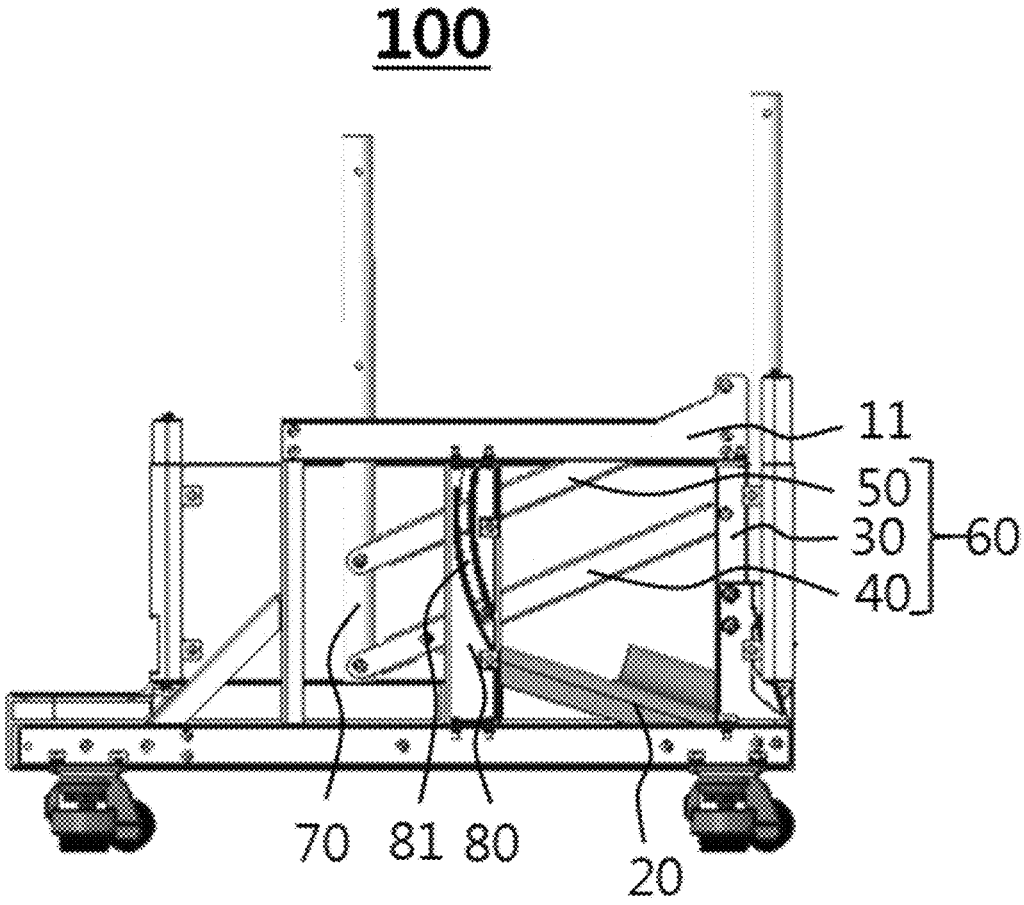
Figure 6:
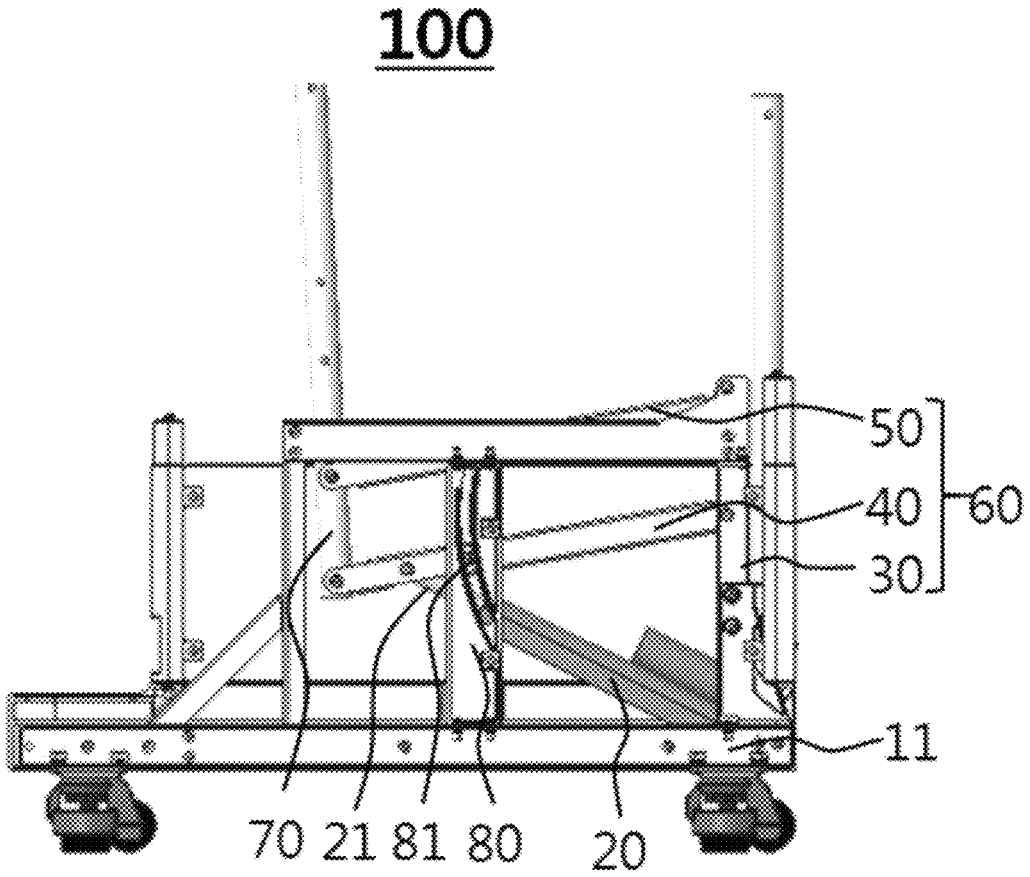

FIG. 1 is a perspective view of an apparatus for aiding a toilet user in standing up according to an embodiment of the disclosure. FIG. 2 is a lateral view of an apparatus for aiding a toilet user in standing up according to an embodiment of the disclosure. FIG. 3 is a lateral view of an apparatus for aiding a toilet user in standing up according to an embodiment of the disclosure before operation (in a movable seat down state), and FIG. 4 is a lateral view of an apparatus for aiding a toilet user in standing up according to an embodiment of the disclosure after operation (in a movable seat up state). FIGS. 5 to 7 are lateral views for explaining operation of a seat actuator in an apparatus for aiding a toilet user in standing up according to an embodiment of the disclosure.

As shown in FIGS. 1 to 7, an apparatus 200 for aiding a toilet user in standing up according to an embodiment of the disclosure includes a movable seat 110 having a structure allowing a user of a toilet 150 to sit thereon, and a seat actuator 100 adjacent to the toilet 150 and controlling movement of the movable seat 110.

The movable seat 110 is movably mounted to the toilet 150. In other words, the movable seat 110 has a structure on which a user of the toilet 150 sits, and is movably mounted to the toilet 150. The movable seat 110 may be a general seat bundled with the toilet 150, or a special seat provided separately from the general seat bundled with the toilet 150.

The movable seat 110 has a structure that a user of the toilet 150 can sit on. Further, the movable seat 110 may be configured for direct contact with hips of a toilet user, or may be configured to indirectly contact and support the hips of the user with an additional medium (or a separate seat, etc.) interposed between the movable seat 110 and the hips.

The movable seat 110 is not immovably but movably mounted to the toilet 150, and therefore fastened to the seat actuator 100 as put on the rim of the toilet 150. In other words, the movable seat 110 is mounted onto the rim of the toilet 150 as fastened to the seat actuator 100, and thus kept movable corresponding to operations of the seat actuator 100.

The movement of the movable seat 110 is driven by the seat actuator 100. That is, the movable seat 110 has lifting movement and/or pivoting movement according to the operations of the seat actuator 100 so that a user of the toilet 150 can stand up, i.e. rise from the movable seat 110. The seat actuator 100 operates to make the movable seat 110 have either the lifting movement or the pivoting movement or have both the lifting movement and the pivoting movement.

Thus, the seat actuator 100 according to the disclosure is adjacent to the toilet 150 and controls the movement of the movable seat 110 so that the movable seat 110 can have at least one of the lifting movement and the pivoting movement.

The seat actuator 100 needs to have a structure to be conveniently and easily installed without spoiling an outer appearance since it is provided adjacent to the toilet 150 and makes the movable seat 110 move, i.e. have at least one movement between the lifting movement corresponding to vertical reciprocation and the pivoting movement corresponding to rotation.

Like this, the seat actuator 100 is required to have an easy and simple structure to be disposed adjacent to the toilet 150 and a structure for arrangement and miniaturization to occupy a minimum installation space. To this end, the seat actuator 100 may have various structures. The seat actuator 100 according to the disclosure employs a structure to be simply and easily installed at a side of the toilet 150 while occupying the minimum installation space. That is, the seat actuator 100 according to the disclosure is configured to operate the movable seat 110 through a simple structure without a gear assembly or the like complicated structure.

The seat actuator 100 according to the disclosure basically includes a base frame 11 adjacent to and stationarily mounted to the toilet 150, a driver 20 mounted to the base frame 11, and a link assembly 60 produces lifting movement and pivoting movement of the movable seat 110 as driven by the driver 20.

With this configuration, the seat actuator 100 is covered with a case 10 to embellish an outer appearance and protect the foregoing elements. That is, the base frame 11, the driver 20 and the link assembly 60 are provided inside the case 10.

Meanwhile, the seat actuators 100 according to the disclosure may form a pair to be respectively arranged at both lateral sides of the toilet 150. In other words, as shown in FIGS. 1 to 7, the seat actuators 100 according to the disclosure are respectively arranged at the opposite sides of the toilet 150 as one pair and operate synchronously with each other.

Like this, according to the disclosure, the seat actuators 100 for actuating the movable seat 110 are respectively arranged at both sides of the toilet 150 to form one pair, and therefore it is advantageously possible to make a smooth operation regardless of the weight of a user who uses the toilet 150 and prevent a failure due to excessive load.

As described above, the seat actuators 100 according to the disclosure may be respectively arranged at the opposite sides of the toilet 150. In this case, the seat actuators 100 have the same configurations and operations. Therefore, the configuration and operations of one seat actuator 100, i.e. one seat actuator 100 arranged at a first side of the toilet 150 between one pair of seat actuators 100 will be described representatively, and the same description will be applied to the configuration and operations of the other seat actuator 100. Of course, the seat actuator 100 may be arranged at only the first side of the toilet 150.

Below, the configuration and operations of the seat actuator 100, which is the core element of the disclosure, will be described in detail.

The base frame 11 is immovably mounted adjacent to the toilet 150. Specifically, the base frame 11 may be stationarily mounted being coupled to the toilet 150, or the base frames 11 respectively installed at the opposite sides of the toilet 150 may be stationarily mounted being connected to each other.

The base frame 11 makes the driver 20 and the link assembly 60 be disposed with a firm and stable structure, and allows a guide frame 80 (to be described later) to be mounted thereto. In this regard, detailed descriptions will be made below.

The driver 20 is stably mounted to the base frame 11 and drives the link assembly 60 to operate so that an actuation bar 70 coupled to the movable seat 110 can have the lifting movement and the pivoting movement by the link assembly 60.

The link assembly 60 operates as driven by the driver 20 and makes the actuation bar 70 coupled to the movable seat 110 operate. The link assembly 60 is connected to the actuation bar 70. According to the operation of the actuation bar 70, the movable seat 110 may have the lifting movement and the pivoting movement.

In brief, the link assembly 60 is linked to the actuation bar 70 coupled to the movable seat 110 and driven by the driver 20 to make the actuation bar 70 operate so as to produce the lifting movement and the pivoting movement of the movable seat 110.

The actuation bar 70 is firmly coupled to the movable seat 110 and has the lifting movement and the pivoting movement according to the operation of the link assembly 60. The link assembly 60 producing the movement of the actuation bar 70 may be variously configured as long as it can be driven by the driver 20 and transfer the lifting movement and the pivoting movement to the actuation bar 70.

According to an embodiment of the disclosure, the link assembly 60 includes a stationary link 30 vertically connected to the base frame 11, a first pivoting link 40 having a first end pivotally connected to the stationary link 30 and a second end pivotally connected to the actuation bar 70, and a second pivoting link 50 placed above the first pivoting link 40 and having a first end pivotally connected to the stationary link 30 and a second end pivotally connected to the actuation bar 70.

The stationary link 30 is firmly and stably coupled to the base frame 11 and makes the first pivoting link 40 and the second pivoting link 50 be stably and pivotally coupled thereto. The first ends of the first pivoting link 40 and the second pivoting link 50 are pivotally connected to the stationary link 30, and the first pivoting link 40 is placed below the second pivoting link 50.

The first pivoting link 40 has the first end pivotally coupled to the stationary link 30 and the second end pivotally coupled to the actuation bar 70. Likewise, the second pivoting link 50 has the first end pivotally coupled to the stationary link 30 and the second end pivotally coupled to the actuation bar 70. However, the second pivoting link 50 is placed above the first pivoting link 40.

Like this, the first ends of the first pivoting link 40 and the second pivoting link 50 are pivotally coupled to the stationary link 30, and the second end thereof are pivotally coupled to the actuation bar 70, so that the actuation bar 70 can operate when the driver 20 applies a driving force to the first pivoting link 40 or the second pivoting link 50, and therefore the movable seat 110 coupled to the actuation bar 70 can operate to have the lifting movement and the pivoting movement.

The driver 20 includes a driving shaft 21 pivotally connected to the first pivoting link 40 or the second pivoting link 50. To make the driver 20 have the minimum driving load and enhance driving stability, the driving shaft 21 may be connected to a portion adjacent to a point at which pivotal connection with the actuation bar 70 is made, i.e. a portion adjacent to the second end of the first pivoting link 40 or second pivoting link 50.

Because the first pivoting link 40 and the second pivoting link 50 have not only the lifting movement but also the pivoting movement, the driver 20 is also pivotally connected to the first pivoting link 40 or the second pivoting link 50. Specifically, the driver 20 is pivotally connected to the base frame 11 or the stationary link 30, and the driving shaft 21 of the driver 20 is driven to move forward and backward by the driver 20 as pivotally connected to the first pivoting link 40 or the second pivoting link 50.

Because the driving shaft 21 of the driver 20 is pivotally coupled to the first pivoting link 40 or the second pivoting link 50, the actuation bar 70 connecting with the second ends of the first pivoting link 40 and the second pivoting link 50 may operate to have the lifting movement and the pivoting movement as the driving shaft 21 is driven to move forward and backward.

Meanwhile, the first pivoting link 40 and the second pivoting link 50 have the pivoting movement as driven by the driver 20, and thus the driver 20 is also pivotally connected and coupled to the first pivoting link 40 or the second pivoting link 50. The lower end of the driver 20 is pivotally coupled to the base frame 11 or the stationary link 30.

The driver 20 may employ various drivers such as a hydraulic cylinder, a pneumatic cylinder, etc. Further, the driver 20 may be pivotally coupled to the first pivoting link 40 by taking structural stability and operation without interference into account.

Meanwhile, the movable seat 110 operates to have both the lifting movement and the pivoting movement, and therefore the actuation bar 70 coupled to the movable seat 110 is also required to connect with the first pivoting link 40 and the second pivoting link 50 to thereby generate both the lifting movement and the pivoting movement.

To this end, the first pivoting link 40 and the second pivoting link 50 according to an embodiment of the disclosure are arranged in parallel with each other, and the second pivoting link 50 is longer than the first pivoting link 40. In detail, the first pivoting link 40 and the second pivoting link 50 are pivotally coupled to the stationary link 30 and the actuation bar 70 while being in parallel with each other, and the length (i.e. a distance from a point for pivotally coupling with the stationary link 30 to a point for pivotally coupling with the actuation bar 70) of the second pivoting link 50 placed above is greater than the length (i.e. a distance from a point for pivotally coupling with the stationary link 30 to a point for pivotally coupling with the actuation bar 70) of the first pivoting link 40 placed below. In this case, the stationary link 30 is coupled and disposed vertically to the base frame 11.

Due to difference in arrangement and length between the first pivoting link 40 and the second pivoting link 50, the movable seat 110 may operate to have both the lifting movement and the pivoting movement while moving from a down state (see FIGS. 3 and 5) to an up state (FIGS. 4, 6 and 7).

Meanwhile, the operation of the first pivoting link 40 and the second pivoting link 50 may be guided for the structural stability. To this end, the first pivoting link 40 or the second pivoting link 50 according to an embodiment of the disclosure further includes a guide pin 41. Further, the guide frame 80 having a guide hole 81 may be stationarily coupled perpendicularly to the base frame 11, so that the guide pin 41 can be guided while moving as inserted therein.

That is, the first pivoting link 40 or the second pivoting link 50 according to an embodiment of the disclosure further includes the guide pin 41, and the guide frame 80 connected vertically to the base frame 11 is further provided having the guide hole 81 to guide the guide pin 41 moving according to the movement of the first pivoting link 40 or the second pivoting link 50.

As described above, it is preferable that the driving shaft 21 of the driver 20 is connected to the first pivoting link 40, and therefore it is preferable that the guide pin 41 is also provided in the first pivoting link 40 when structural stability and easy maintenance and replacement are taken into account. In result, the second pivoting link 50 is used for a long time because it is hardly likely to be damaged, whereas the first pivoting link 40 is replaced at every damage because it is relatively highly likely to be damaged.

As described above, when the apparatus 200 for aiding a toilet user in standing up according to an embodiment of the disclosure changes from the state shown in FIG. 3 (i.e. the down state) to the state shown in FIG. 4 (i.e. the up state), the movable seat 110 is minutely pivoted while being lifted up, thereby assisting the toilet user in stably standing up. As shown in FIGS. 5 to 7, the movable seat 110 is pivoted while the actuation bar 70 is driven to move up by the driver 20, and therefore operates to have both the lifting movement and the pivoting movement.

Meanwhile, the apparatus 200 for aiding a toilet user in standing up according to an embodiment of the disclosure may include a first safety bar 90 and a second safety bar 95 to assist a user's behavior while taking his/her safety into account.

The first safety bar 90 is provided on either side of the movable seat 110. Therefore, a user can sit down on the movable seat 110 or stand up from the movable seat 110 with assistance of the first safety bar 90, and further take a stable posture by resting an arm on the first safety bar 90 or holding the first safety bar 90 while sitting down on the movable seat 110 and relieving nature. Further, the second safety bar 95 may be mounted to a rear side of the toilet 150 and assist a user in moving.

The first safety bar 90 includes a pair of vertical bars 91, a horizontal bar 93, and a connector 92 for connecting the vertical bar 91 and the horizontal bar 93. The pair of vertical bars 91 is coupled to the movable seat 110, and the connector 92 is inserted in and coupled to each top end of the pair of vertical bars 91. The horizontal bar 93 is horizontally inserted in and coupled to the connector 92.

Here, one of the pair of vertical bars 91 may be the actuation bar 70. Therefore, the actuation bar 70 penetrates the movable seat 110 and extends to protrude upward, and has the top end to which the connector 92 is coupled. The actuation bar 70 is firmly coupled to the movable seat 110 while penetrating the movable seat 110, and the connector 92 is coupled to the top end of the actuation bar 70. With this structure, the coupling structure of the movable seat 110 and the coupling structure of the first safety bar 90 are further reinforced, and the movable seat 110 and the first safety bar 90 are also easily assembled and disassembled.

The second safety bars 95 are connected to the rear sides of the based frame 11 disposed on the opposite sides of the toilet 150 and extended upward to meet together at an upper side.

Although a few exemplary embodiments of the disclosure have been shown and described, these are for illustrative purpose only and it will be appreciated by those skilled in the art that changes may be made in these embodiments without departing from the principles and spirit of the invention, the scope of which is defined in the appended claims and their equivalents.

What is claimed is:

1. An apparatus for aiding a user of a toilet in standing up, which has a structure where the user can sit, and comprises a movable seat movably mounted to the toilet; and a seat actuator disposed adjacent to the toilet and actuating the movable seat to operate having at least one of lifting movement and pivoting movement, the seat actuator comprising: a base frame adjacent to and stationarily mounted to the toilet; a driver mounted to the base frame; and a link assembly connected to an actuation bar coupled to the movable seat and making the actuation bar operate as driven by the driver to generate the lifting movement and the pivoting movement of the movable seat, the link assembly comprising: a stationary link connected vertically to the base frame; a first pivoting link comprising a first end pivotally connected to the stationary link and a second end pivotally connected to the actuation bar; and a second pivoting link placed above the first pivoting link and comprising a first end pivotally connected to the stationary link and a second end pivotally connected to the actuation bar, the driver being pivotally connected to the base frame or the stationary link, and comprising a driving shaft driven to move forward and backward by the driver as pivotally connected to the first pivoting link or the second pivoting link, and the first pivoting link and the second pivoting link being arranged in parallel with each other, and the second pivoting link being longer than the first pivoting link, wherein the first pivoting link or the second pivoting link further comprises a guide pin, and a guide frame connected perpendicularly to the base frame is further provided comprising a guide hole configured to guide the guide pin moving according to the movement of the first pivoting link or the second pivoting link.

* * * * *